United States Patent [19]

Goldfarb et al.

[11] 4,449,665

[45] May 22, 1984

[54] ADJUSTABLE TRACK

[75] Inventors: Adolph E. Goldfarb, 4614 Monarca Dr., Tarzana, Calif. 91356; Delmar K. Everitt, Woodland Hills, Calif.

[73] Assignee: Adolph Eddy Goldfarb, Westlake Village, Calif.

[21] Appl. No.: 347,450

[22] Filed: Feb. 10, 1982

[51] Int. Cl.[3] ..... A63H 18/04; E01B 23/00

[52] U.S. Cl. ..... 238/10 R; 238/10 F

[58] Field of Search ..... 238/10 R, 10 A, 10 B, 238/10 C, 10 E, 10 F; 104/53, 69, 134, 304, 305; 46/1 K, 216, 257, 202

[56] References Cited

U.S. PATENT DOCUMENTS

| | | | |
|---|---|---|---|
| Re. 30,454 | 12/1980 | Birdsall | 238/10 F |
| 1,745,241 | 1/1930 | Bartlett | 104/69 X |
| 3,218,757 | 11/1965 | Benkoe | 104/53 X |
| 3,442,047 | 5/1969 | Quigley et al. | 46/202 |
| 3,579,904 | 5/1971 | Genin | 238/10 E |
| 3,613,306 | 10/1971 | Arai | 46/216 |
| 3,750,945 | 8/1973 | Warr | 238/10 E |
| 3,775,897 | 12/1973 | Soulakis et al. | 238/10 R X |
| 4,140,276 | 2/1979 | Halford | 238/10 F X |
| 4,241,875 | 12/1980 | Vandenbrink | 238/10 F |

FOREIGN PATENT DOCUMENTS

| | | | |
|---|---|---|---|
| 2846350 | 4/1980 | Fed. Rep. of Germany | 46/202 |

*Primary Examiner*—Randolph Reese

*Attorney, Agent, or Firm*—Romney, Golant, Martin, Disner & Ashen

[57] ABSTRACT

This toy track is adjustable in its vertical contour, and holds itself in the vertical contour to which it is adjusted. The track is made up of numerous short sections. Each track section carries connectors that fixedly but releasably lock that section to an adjacent section, at a vertical angle selectable arbitrarily by the user of the toy.

The connectors have mating pin-and-slot combinations for coupling adjacent track sections so that adjacent sections can rotate vertically with respect to one another. In addition the connectors have mating protuberance-and-groove combinations for locking the adjacent sections in particular vertical-rotation positions—that is, at the arbitrarily user-selectable angles.

The connectors are secured at opposite sides (laterally, relative to vehicle motion along the track) of each track section, and the connectors extend longitudinally beyond that track section to engage like connectors of the adjacent section. The connectors are upstanding from the roadbed sections and form sides for the adjustable track. Ninety degree turns and turnaround gates for use with the adjustable track are also provided.

16 Claims, 11 Drawing Figures

ADJUSTABLE TRACK

TECHNICAL FIELD

The invention relates to the field of track for toy vehicles and, in particular, to track which is adjustable to a selected contour.

BACKGROUND ART

For some time now, one of the most exciting areas of entertainment for children has involved the use of toy vehicles and track for such vehicles. Slot cars and railroad trains have used intricate track set-ups composed of permanently formed sections to increase the play value of such types of vehicles. Simpler toy vehicles have utilized flexible track which could be gently bent to a certain degree and used with permanently molded curves and loops to provide a somewhat complicated track set-up. With the use of flexible track, inclines could also be made which would have a variety of slopes ranging from gentle to steep but which would not be susceptible of rapid or discontinuous changes in slope. For these latter types of slopes, molded non-adjustable track portions have been provided which would simulate rough terrain or enable rapid slope changes to be achieved.

Accordingly, it is a general object of the present invention to provide an improved track for use with toy vehicles.

It is another object of the present invention to provide an improved track which can be adjusted to have a selected contour.

It is a further object of the present invention to provide an improved track which can be adjusted to have rapid or discontinuous changes in slope.

It is still another object of the present invention to provide an improved track which can be adjusted to simulate a rough terrain.

It is still a further object of the present invention to provide an improved track having an improved turn around and an improved corner.

DISCLOSURE OF INVENTION

An adjustable track for use with toy vehicles is provided. The track comprises a plurality of roadbed sections and connectors coupled to the roadbed sections for fixedly but releasably interlocking the roadbed sections with one another at selected angles to form a track having a selected contour. The angles and thus the contour of the track can be readily changed whenever desired. In a particular embodiment, the connectors are coupled to opposite sides of the roadbed sections and extend beyond the sides of the roadbed sections to engage like roadbed sections and like connectors between them. The connectors have pins extending from first ends and the like connectors have slots in first ends which are adapted to mate to rotatably couple the roadbed sections. The connectors also have a plurality of grooves at the first ends and the like connectors have one or more protuberances at the first ends which are adapted to mate to lock the roadbed sections at the selected angles. The connectors also have slots in and protuberances on second ends adapted to mate with pins and grooves on second ends of like connectors so that all the connectors can be coupled to one another with the roadbed sections therebetween to form the adjustable track. The connectors are also upstanding from the roadbed sections and form sides for the adjustable track. Ninety degree turns and turnaround gates for use with the adjustable track are also provided.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only and are not intended as a definition of the limits of the invention.

BEST MODE FOR CARRYING OUT THE INVENTION

Figure 1:
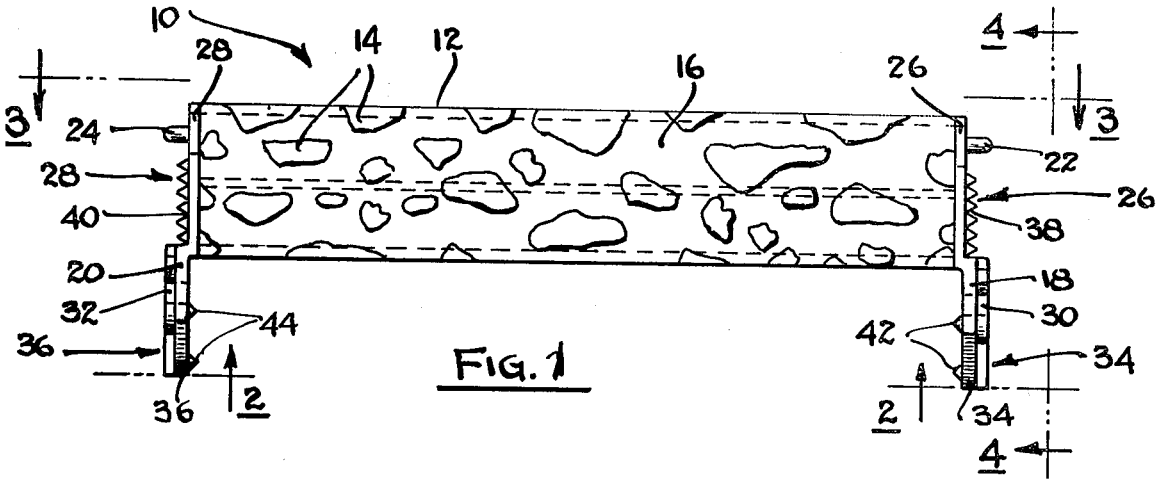
FIG. 1 is a top plan view of an adjustable track element of a preferred embodiment of the present invention.
Figure 2:
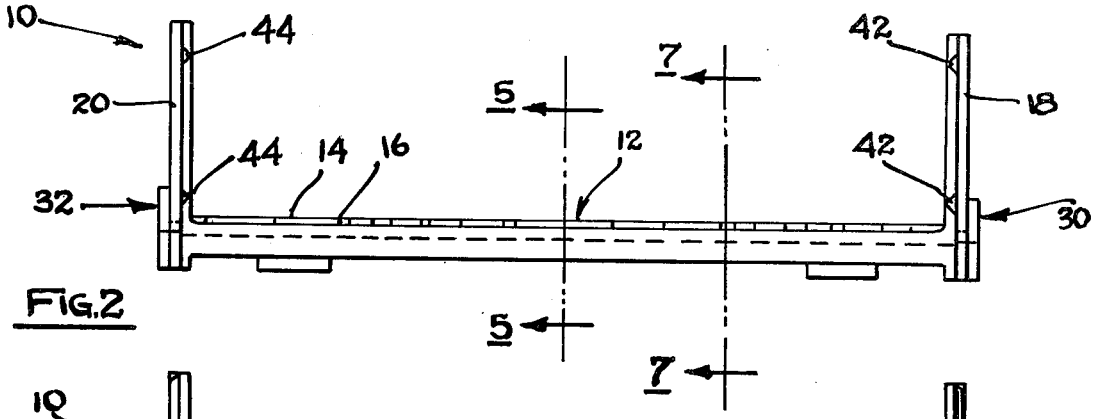
FIG. 2 is an end view of the adjustable track element of FIG. 1 taken along line 2—2.
Figure 3:
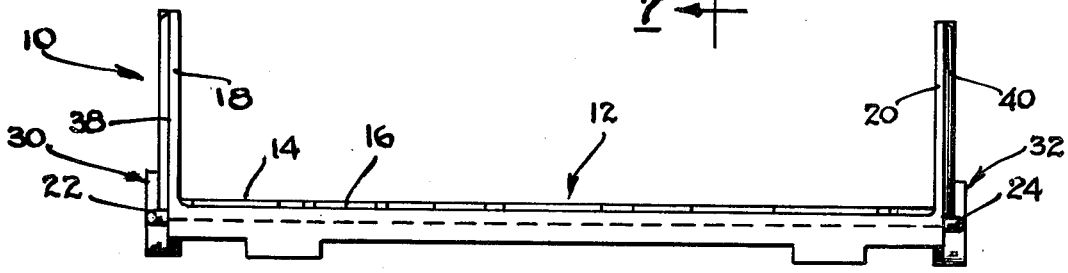
FIG. 3 is an end view of the adjustable track element of FIG. 1 taken along line 3—3.
Figure 4:
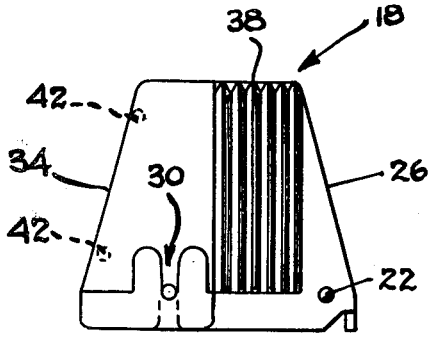
FIG. 4 is a side view of the adjustable track element of FIG. 1 taken along line 4–4.
Figure 5:
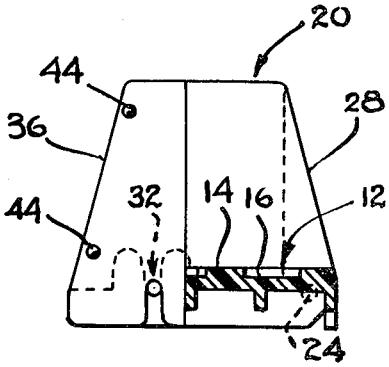
FIG. 5 is a cross-sectional view of the adjustable track element of FIG. 1 taken along line 5—5 of FIG. 2.
Figure 6:
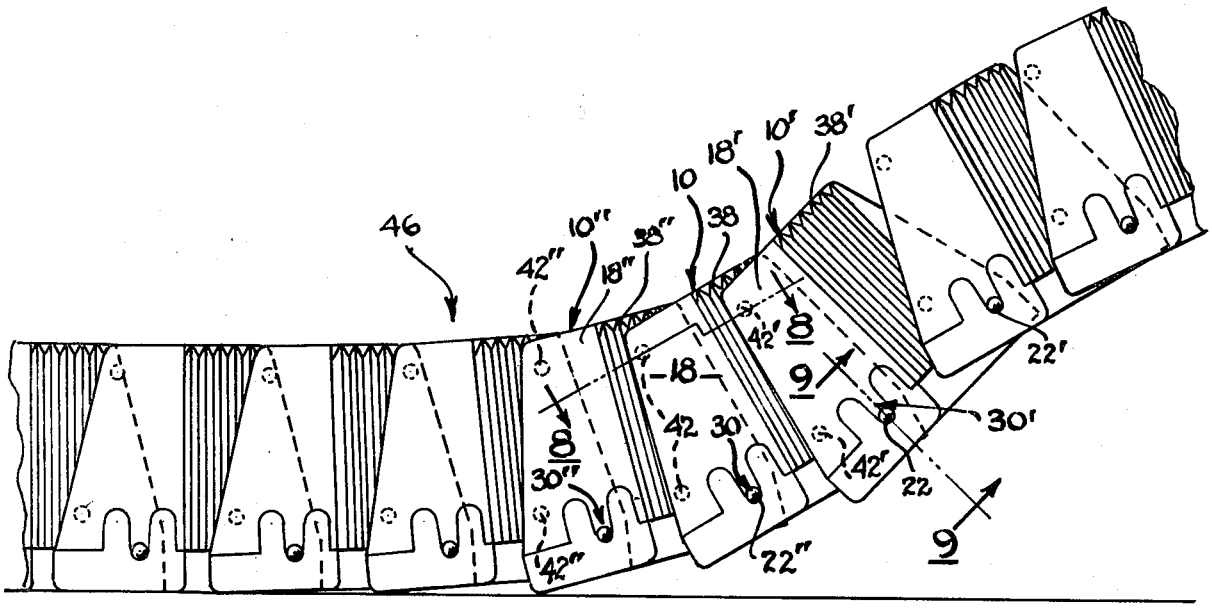
FIG. 6 is a side view of a preferred embodiment of the adjustable track of the present invention.

Referring now to FIG. 1 a top plan view of an adjustable track element 10 of a preferred embodiment of the present invention is illustrated. The track element 10 has a roadbed 12 which has raised portions 14 thereon to add texture to the surface 16 of the roadbed 12. Attached to the roadbed 12 are a pair of connectors 18,20 which, as shown in FIGS. 2–5, are upstanding from the roadbed 12 and serve as sides to the roadbed 12. These sides provide smooth inside surfaces which minimize drag on the toy vehicles when they engage those surfaces. Each of the connectors 18,20 have pins 22,24 extending from first ends 26,28 thereof and slots 30,32 formed in second ends 34,36 thereof extending beyond the roadbed 12. In addition, each of the connectors 18,20 have a plurality of grooves 38,40 in the first ends 26,28 and one or more protuberances 42,44 extending from the second ends 34,36. The track elements may be made of various suitable materials such as molded plastic which will give the elements a degree of flexibility and resilience for purposes of interconnection and adjustment of track elements as described below.

Figure 7:
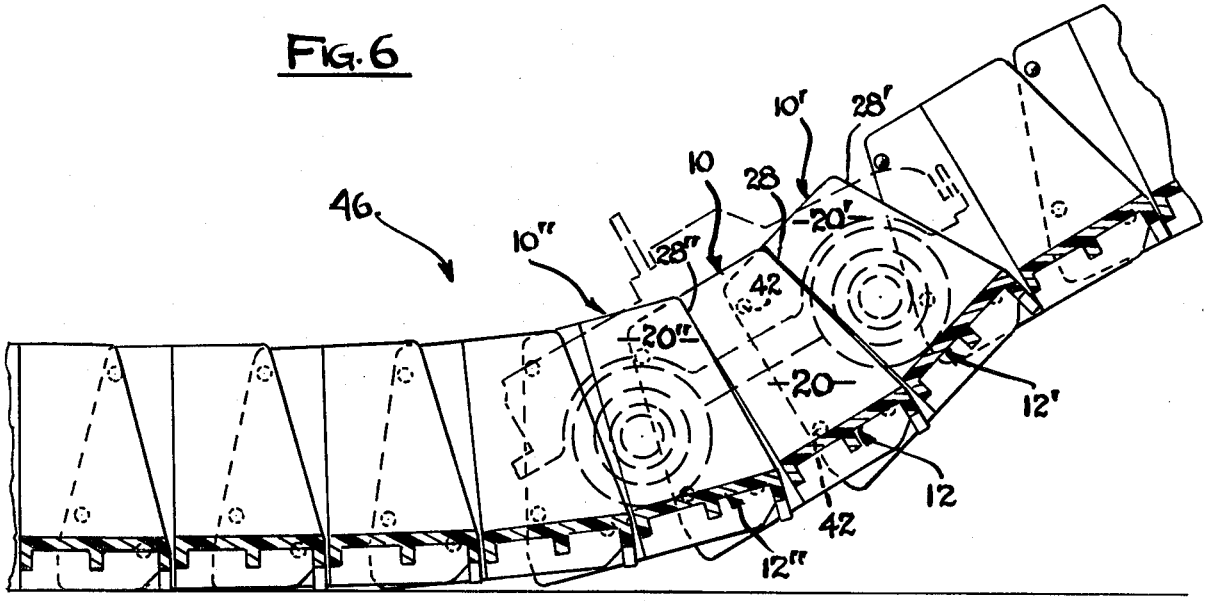
FIG. 7 is a cross-sectional side view of the adjustable track of FIG. 6 taken along a line corresponding to line 7—7 of FIG. 2.
Figure 8:
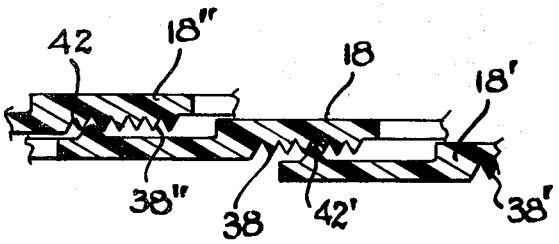
FIG. 8 is a cross-sectional view of the adjustable track of FIG. 6 taken along line 8—8.
Figure 9:
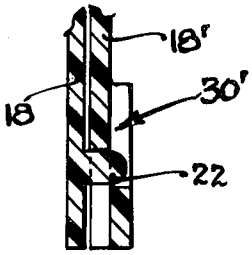
FIG. 9 is a cross-sectional view of the adjustable track of FIG. 6 taken along line 9—9.

As is shown in FIGS. 6–9, the various elements of the connectors 18,20 are adapted to mate with like elements of like connectors when the like connectors and its associated roadbed from a like track element are inserted between the second ends 34,36 of the connectors 18,20 extending beyond the roadbed 12, and when the connectors 18,20 and the roadbed 12 are inserted between like extending second ends of like connectors of a like track element to form the adjustable track 46. Thus in FIG. 6 track elements 10,10',10" are shown coupled together by connectors 18,18',18". Pin 22 of connector 18 is inserted into slot 30' of connector 18', as shown in FIG. 9, while protuberances 42' of connector 18' are engaged with grooves 38 of connector 18, as shown in FIG. 8. Similarly, protuberances 42 of connector 18 are engaged with grooves 38" of connector 18", as shown in FIG. 8, while pin 22" of connector 18" is inserted into slot 30 of connector 10. Likewise pin 22' of connector 10' is inserted into the slot of its adjacent connector while protuberances 42" of connector 10" engage the grooves of its adjacent connector.

Pins 22,22',22" and slots 30,30',30" thus serve to rotatably couple the track elements 10,10',10", while protuberances 42,42',42" and grooves 38,38',38" lock the roadbeds 12,12',12" at selected angles to form a selected contour for the adjustable track 46. This contour is illustrated in FIG. 7 in which the roadbeds 12,12',12" are shown in cross-section carrying a vehicle, in phantom, with the smooth interior surfaces of the ends 28,28',28" of the connectors 20,20',20" serving as one side for the adjustable track 46. As shown in FIG. 7 the transition between roadbeds 12,12',12" can be abrupt, depending on the angle selected, so that the changes in slope can be rapid or even discontinuous to simulate a rough terrain, with the protuberances and the grooves serving to fixedly but releasably lock the selected contour in place. This contour can of course be changed whenever desired by the user.

Figure 10:
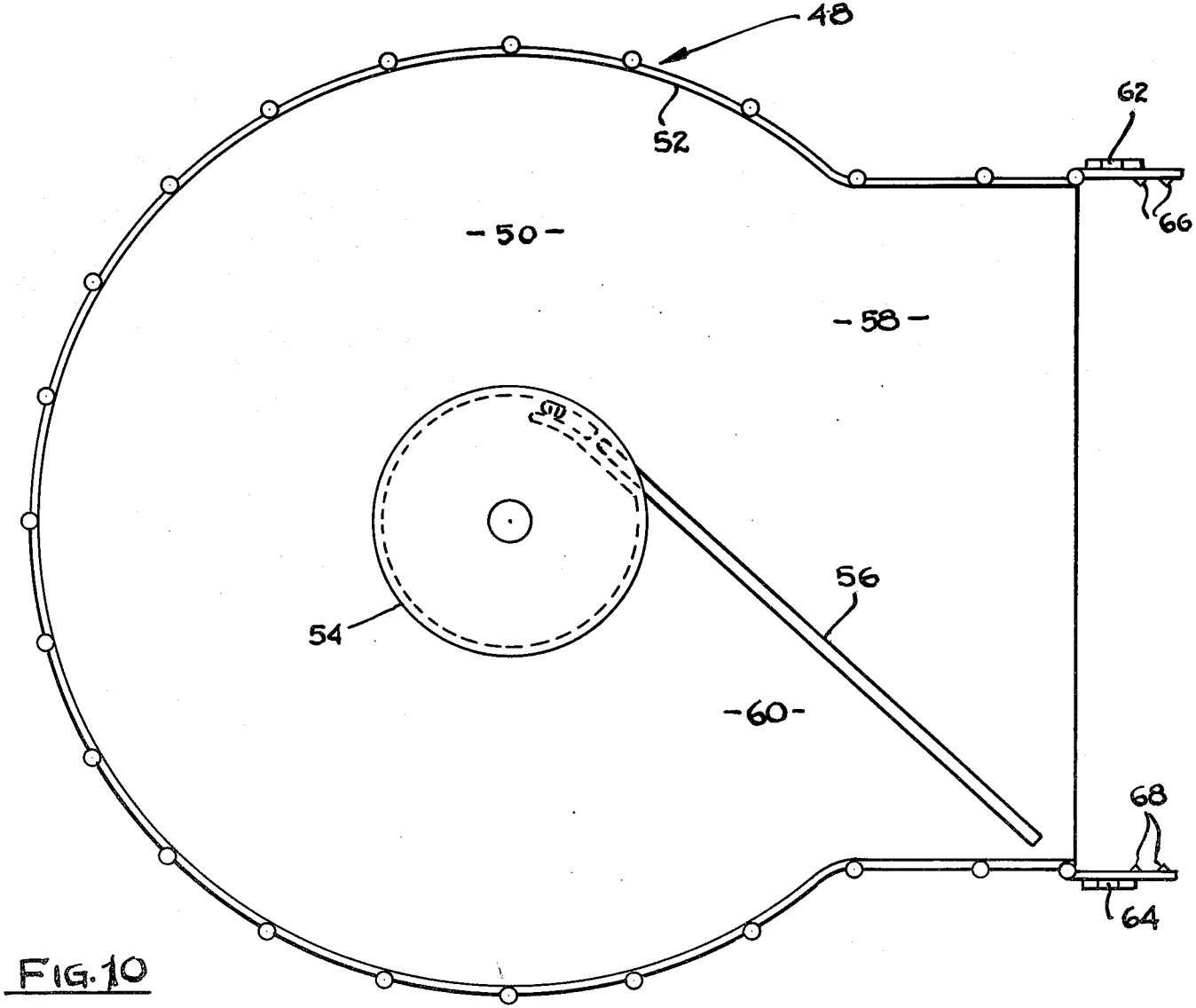
FIG. 10 is a top plan view of a turnaround gate for use with the present invention.

Referring now to FIG. 10 a top plan view of a turnaround gate 48 for use with the adjustable track 46 of the present invention is illustrated. The gate 48 consists of a circular track portion 50 bounded by an outer wall 52 and an inner wall 54 of sufficient height that a vehicle could not climb over the walls 52,54, generally a height higher than the center line of the tires, which walls 52,54 urge the vehicle into a direction opposite the initial direction of the vehicle. The gate 48 has a deflector 56 coupled to the inner wall 54 which allows vehicles to enter into the circular track portion 50 through opening or entrance region 58 and prevents them from entering through opening or exit region 60, thus determining the direction of rotation of vehicles entering the gate 48. The deflector 56 is generally made out of a flexible material so that a vehicle exiting from the gate 48 through opening 60 will merely push aside the deflector 56 and exit from the gate 48, while a vehicle trying to enter the opening 60 will push the deflector clockwise against 56 the outer wall 52 and to be nonmovable from that position by the vehicle. Alternatively, the deflector 56 could be rigid and coupled to the inner wall 54 by a spring-loaded hinge to perform the same function. Outer wall 52 also has at the ends thereof near the entrance to the gate 48 slots 62,64 and protuberances 66,68 to engage the pins 22,24 and the grooves 38,40 of connectors 18,20 of track element 10. The side wall surfaces of the gate are smooth to avoid drag. The floor is also smooth to permit the wheels to slip so the toy vehicle can turn and change direction as it passes through the gate.

Figure 11:
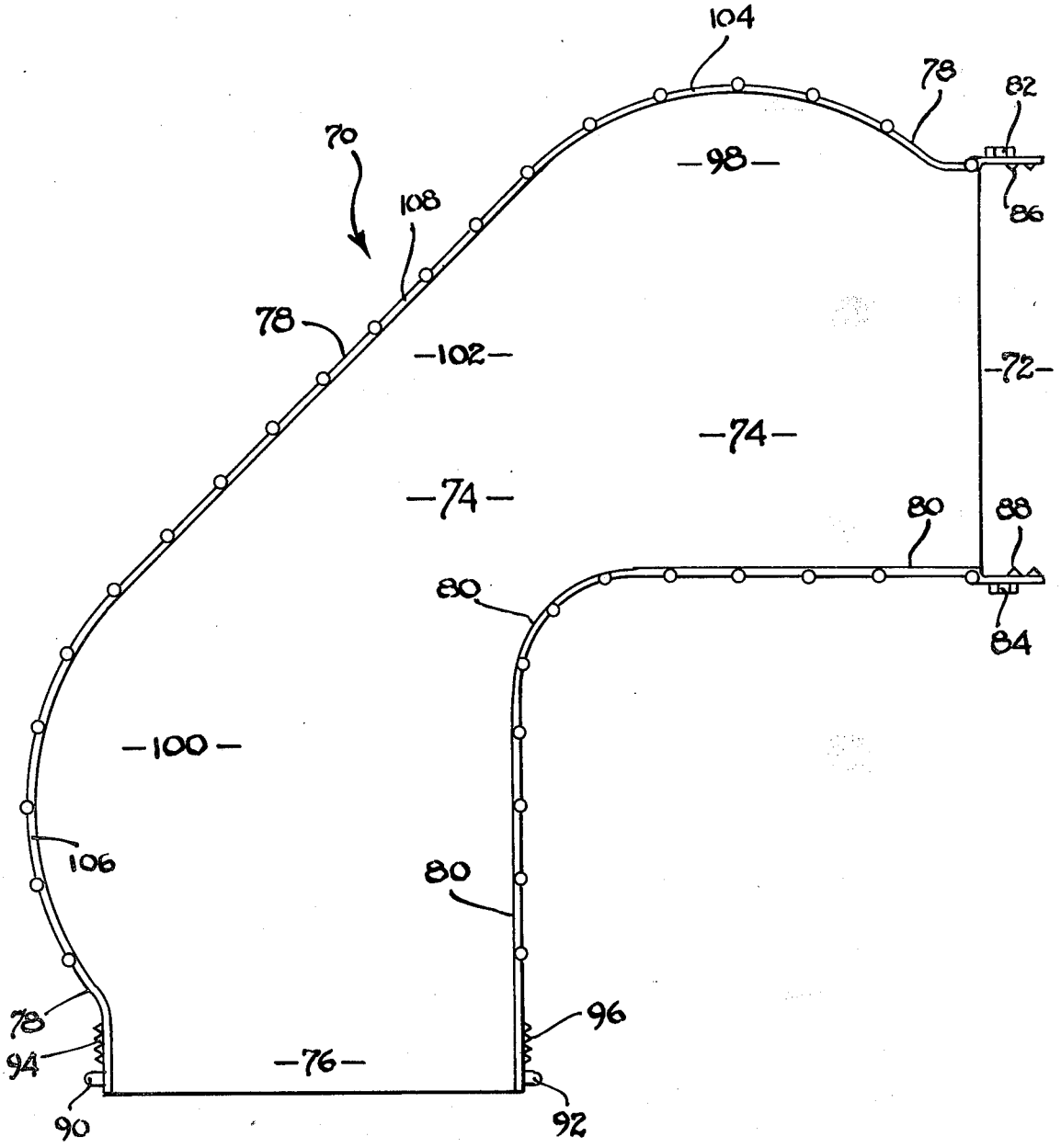
FIG. 11 is a top plan view of a ninety degree turn for use with the present invention.

In FIG. 11, a ninety degree turn 70 for use with the adjustable track 46 of the present invention is illustrated. The turn 70 consists of entrance region 72, deflection region 74 and exit region 76, all bounded by outer wall 78 and inner wall 80. The outer and inner walls 78,80 in the entrance region 72 have slots 82,84 and protuberances 86,88 to engage the pins 22,24 and the grooves 38,40 of connectors 18,20 of the track element 10. The outer and inner walls 78,80 in the exit region have pins 90,92 and grooves 94,96 to engage the slots 30,32 and the protuberances 42,44 of the track element 10. The deflection region 74 consists of expanded regions 98,100 and a narrow region 102, formed by the inner wall 80 and curved portions 104,106 and straight portion 108 of the outer wall 78.

In operation, the vehicle enters the turn 70 at region 72 and encounters the straight portion 108 of the outer wall 78 in the narrow region 102. This turns the vehicle so that it then goes along the straight portion 108 of the outer wall 78 while traversing the narrow region 102 and then encounters curved portion 106 of the outer wall 78 which acts to deflect the vehicle into the center of the region 76 and prevents the vehicle from clinging to the outer wall 78, thus facilitating the exiting of the vehicle from turn 70. The curved portion 106 thus acts to overcompensate for the turn 70 in expanded region 100 and causes the vehicle to exit the turn 70 in the center of the attached track element 10. Expanded region 98 and curved portion 106 of the outer wall act to similarly deflect vehicles going in the opposite direction and are not necessary if the turn 70 is only going to be used as a left turn for a one-way track, as shown in FIG. 11. The outer and inner walls 78,80 are, as before, of a sufficient height so that a vehicle could not climb over them, generally a height higher than the center line of the tires. The length of expanded region 100 is approximately equal to or greater than the length of the vehicle going through the turn 70. If the expanded region 100 is too short, then the vehicle will not be sufficiently deflected to exit the turn 70 in the center of the attached roadbed element 10. Finally, the turn 70 does not have to be ninety degrees but can range from merely a small angular deflection to the turnaround of FIG. 10 or even greater angles. The floor and sidewalls are smooth as with the gate for like reasons.

Having thus described the invention, it is obvious that numerous modifications and departures may be made by those skilled in the art. The placement of the pins and grooves and the slots and protuberances could be interchanged and the pins and grooves positioned to face inwardly and the protuberances outwardly without affecting the operation of the invention. Likewise the grooves and protuberances could be replaced by various other engaging means, such as by applying a tacky medium or the product sold under the trademark "velcro" to the inner surfaces of the sides and pressing them together to engage. Thus the invention is to be construed as being limited only by the spirit and scope of the appended claims.

INDUSTRIAL APPLICABILITY

The adjustable track and turns are useful in conjunction with toy vehicles for entertainment purposes.

We claim:

1. An adjustable toy track element comprising:

a toy roadbed section; and connecting means coupled to said roadbed section for fixedly but releasably locking said roadbed section at a selected generally vertical angle with a roadbed section having a like connecting means coupled thereto to form an adjustable track having a self-sustaining selected elevational contour.

2. The track element of claim 1 wherein said connecting means are coupled to opposite sides of said roadbed section.

3. The track element of claim 2 wherein said connecting means comprise a left-hand portion and a right-hand portion that both extend longitudinally beyond the sides of said roadbed section and that are adapted:

to include between them the entire width of said like roadbed section, to fit closely one on each side of said like roadbed section, and to there engage said like roadbed section and said like connecting means.

4. The track element of claim 3 wherein:

said connecting means have pins extending laterally therefrom; and said like connecting means have slots therein;

said pins and said slots being adapted to mate to couple said roadbed sections for generally vertical mutual rotation about a generally horizontal axis.

5. The track element of claim 3 wherein:

said connecting means have a plurality of grooves therein; and said like connecting means have one or more protuberances thereon;

said plurality of grooves and said protuberances being adapted to mate to lock said roadbed sections in said selected generally vertical angle.

6. The track element of claim 1 wherein said connecting means comprise:

means for coupling said roadbed sections for mutual rotation about a generally horizontal axis; and means for fixedly but releasably locking said roadbed sections at selected generally vertical angles with one another.

7. The track element of claim 6 wherein said means for rotatably coupling said roadbed sections comprise:

a pin extending from one end of said connecting means; and a slot formed in another end of said connecting means;

said pin and slot being adapted to mate respectively with a slot and a pin in said like connecting means to rotatably coupled said roadbed sections.

8. The track element of claim 7 wherein:

said means for locking said roadbed sections comprise:

at least two grooves in one end of said connecting means, and one or more protuberances at another end of said connecting means, each groove being adapted to mate with at least one protuberance in said like connecting means, and each protuberance being adapted to mate with any one of a plurality of the grooves of said like connecting means, to lock said roadbed sections in said selected contour; and said pins and said plurality of grooves are at one end of said connecting means and said slot and said protuberances are at another end of said connecting means.

9. The track element of claim 8 further comprising:

a turnaround gate having an outer wall with slots therein and protuberances thereon at the entrance and exit regions thereof;

said slots and protuberances being adapted to enable the coupling and locking of said gate to said adjustable track element at a selected vertical angle.

10. The track element of claim 8 further comprising:

a turn having inner and outer walls at the entrance and exit regions thereof;

said inner and outer walls at said entrance region having slots therein and protuberances thereon and said inner and outer walls at said exit region having pins and grooves thereon; and said slots and protuberances being adapted to enable the coupling and locking of said turn to said adjustable track elements at a selected vertical angle.

11. The track element of claim 6 wherein said means for locking said roadbed sections comprise:

at least two grooves in one end of said connecting means; and one or more protuberances at another end of said connecting means;

each groove being adapted to mate with at least one protuberance in said like connecting means, and each protuberance being adapted to mate with any one of a plurality of the grooves of said like connecting means, to lock said roadbed sections in said selected contour.

12. An adjustable track element comprising:

a roadbed section; and connecting means coupled to said roadbed section, at opposite sides thereof, for fixedly but releasably interlocking said roadbed section at a selected angle with a roadbed section having a like connecting means coupled thereto to form an adjustable track having a selected contour;

wherein said connecting means are upstanding from said roadbed section and form the sides of said adjustable track.

13. An adjustable toy track comprising:

a plurality of toy roadbed sections; and connecting means secured to each of said roadbed sections for fixedly but releasably locking said roadbed sections at selected generally vertical angles to one another to form and sustain a selected elevational contour.

14. The track of claim 13 wherein said connecting means comprise:

means for coupling said roadbed sections for mutual rotation about generally horizontal axes; and means for fixedly but releasably locking said roadbed sections at selected generally vertical angles with one another.

15. The track of claim 14 wherein said means for rotatably coupling said roadbed sections comprise, in respect of the connecting means secured to each of said sections:

a pin extending from one end of said connecting means; and a slot formed in another end of said connecting means;

said pin and slot being adapted to mate respectively with a slot and a pin in like connecting means secured to an adjacent roadbed section, to rotatably couple said roadbed sections.

16. The track of claim 13 wherein said means for locking said roadbed sections comprise, in respect of the connecting means secured to each of said sections:

at least two grooves in one end of said connecting means; and one or more protuberances at another end of said connecting means;

each groove being adapted to mate with at least one of the protuberances in like connecting means secured to an adjacent roadbed section, and each protuberance being adapted to mate with any one of a plurality of the grooves of said like connecting means, to lock said roadbed sections in said preselected contour.

* * * * *